US009822525B2

(12) United States Patent
Shin et al.

(10) Patent No.: US 9,822,525 B2
(45) Date of Patent: Nov. 21, 2017

(54) METHOD FOR INSTALLING CONCRETE CRACK INDUCING EXPANSION JOINT FILLER, AND APPARATUS THEREFOR

(71) Applicants: Won Su Shin, Daegu (KR); Youn Ho Shin, Daegu (KR)

(72) Inventors: Won Su Shin, Daegu (KR); Youn Ho Shin, Daegu (KR)

( * ) Notice: Subject to any disclaimer, the term of this patent is extended or adjusted under 35 U.S.C. 154(b) by 0 days.

(21) Appl. No.: 15/107,253

(22) PCT Filed: Jan. 9, 2015

(86) PCT No.: PCT/KR2015/000222

§ 371 (c)(1),
(2) Date: Jun. 22, 2016

(87) PCT Pub. No.: WO2015/105368

PCT Pub. Date: Jul. 16, 2015

(65) Prior Publication Data

US 2017/0044757 A1 Feb. 16, 2017

(30) Foreign Application Priority Data

Jan. 9, 2014 (KR) ..... 10-2014-0002719
Jan. 6, 2015 (KR) ..... 10-2015-0001128

(51) Int. Cl.
*E04B 1/68* (2006.01)
*E01C 11/06* (2006.01)
*E01C 11/10* (2006.01)

(52) U.S. Cl.
CPC ..... *E04B 1/6812* (2013.01); *E01C 11/06* (2013.01); *E01C 11/106* (2013.01)

(58) Field of Classification Search
CPC ..... E04B 1/6807; E04B 1/6801; E04B 1/6812
(Continued)

(56) References Cited

U.S. PATENT DOCUMENTS 1,880,725 A * 10/1932 Bleck ..... E01C 11/14 404/48
2,016,858 A * 10/1935 Hall ..... E01C 11/123 404/68

(Continued)

FOREIGN PATENT DOCUMENTS

JP 05-044432 2/1993
KR 20-1996-0022899 7/1996

(Continued)

OTHER PUBLICATIONS

English translation of 20-1996-0022899.
English translation of 10-2001-0063951.

*Primary Examiner* — Basil Katcheves
(74) *Attorney, Agent, or Firm* — Antonio Ha & U.S. Patent, LLC

(57) ABSTRACT

The present invention relates to a method for installing a crack inducing expansion joint filler when placing concrete so as to reduce cracks generated during concrete construction, and an apparatus therefor and, more particularly, to a method for installing a concrete crack inducing expansion joint filler and an apparatus therefor which can vertically install and fix a plurality of fixed rod shafts on a bottom surface, place concrete, and then fit connection means to the fixed rod shafts while connecting and installing a joint filler member, having a cover means which can be attached and detached between the connection means, before the concrete is cured. Thus, since it is possible to install the joint filler member at the same time as placing the concrete on the bottom surface the method and apparatus can significantly reduce the concrete construction period and also cause that cracks generated by the joint filler during concrete curing can be reduced to a minimum, thereby increasing concrete durability and enhancing construction efficiency.

3 Claims, 5 Drawing Sheets

(58) Field of Classification Search
USPC ..... 52/396.05, 365, 367, 396.04
See application file for complete search history.

(56) References Cited

U.S. PATENT DOCUMENTS 2,956,653 A * 10/1960 Liskey, Jr. ..... E04F 15/02405 254/133 A
3,115,726 A * 12/1963 Sayles ..... E04F 21/05 404/136
3,849,958 A * 11/1974 Balzer ..... E04B 1/6804 52/396.05
4,198,176 A * 4/1980 Bentz ..... E01C 11/126 249/9
4,346,542 A * 8/1982 Tateno ..... E01C 11/10 404/48
4,359,845 A * 11/1982 Harrison ..... E02D 31/02 52/169.6
4,695,031 A * 9/1987 Proctor ..... B28B 7/0088 249/112
4,765,106 A * 8/1988 Modrovich ..... E04F 21/22 248/70
5,212,919 A * 5/1993 Shaw ..... E04F 21/05 52/126.6
5,450,699 A * 9/1995 Lee ..... E01C 9/001 404/48
5,666,769 A * 9/1997 Lundquist ..... E02D 27/32 248/188.4
5,956,912 A * 9/1999 Carter ..... E01C 11/106 404/47
6,598,364 B1 * 7/2003 Pelles ..... E01C 11/126 404/47
6,722,097 B2 * 4/2004 Haslem ..... E04C 5/20 52/323
6,898,910 B2 * 5/2005 Bellino, Jr. ..... E01D 22/00 264/35
7,086,203 B2 * 8/2006 Owen ..... E01C 23/01 248/354.3
8,677,712 B1 * 3/2014 Edmonds, Jr. ..... E01C 11/14 165/53
8,869,489 B2 * 10/2014 Findlay ..... E01C 11/126 52/677
9,062,453 B1 * 6/2015 Maziarz ..... E04B 1/68
2003/0115823 A1 * 6/2003 Colefax ..... E01C 9/001 52/677
2007/0256380 A1 * 11/2007 Toffolo ..... E01C 11/106 52/396.06

FOREIGN PATENT DOCUMENTS

KR 20-0129425 8/1998
KR 10-2001-0063951 7/2001
KR 10-0385130 5/2003
KR 10-0542380 1/2006

* cited by examiner

[Fig. 1]
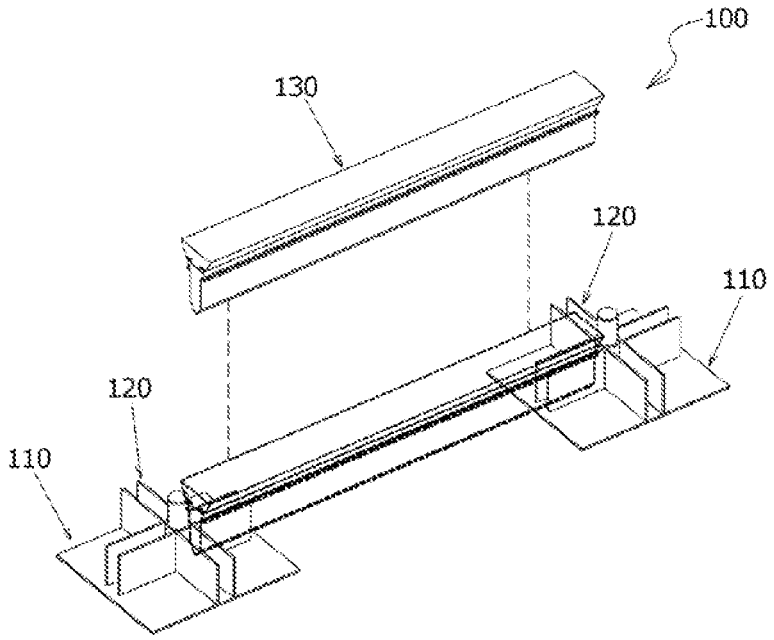
[Fig. 2]
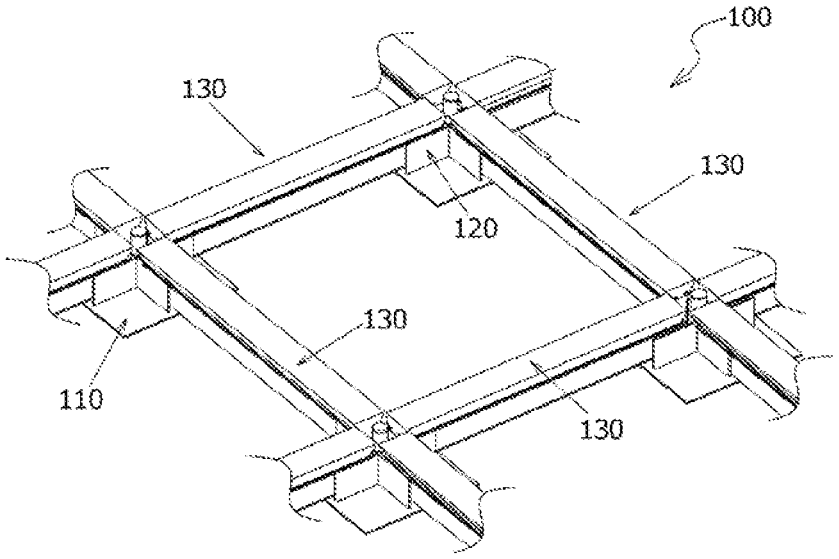

[Fig. 3]
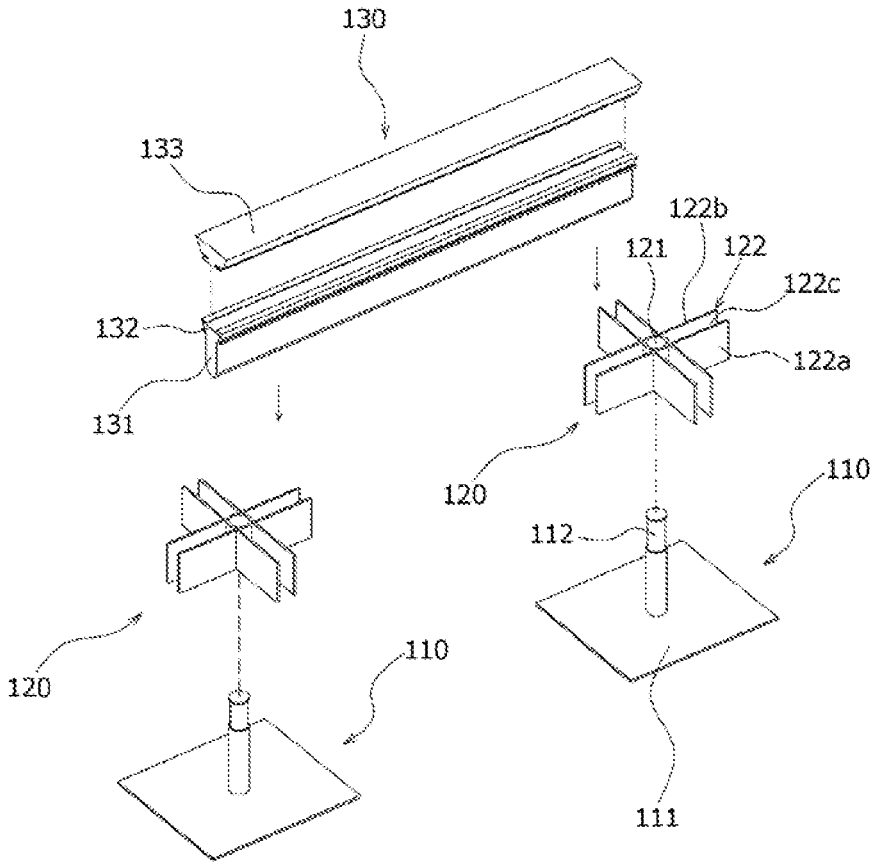

[Fig. 4]
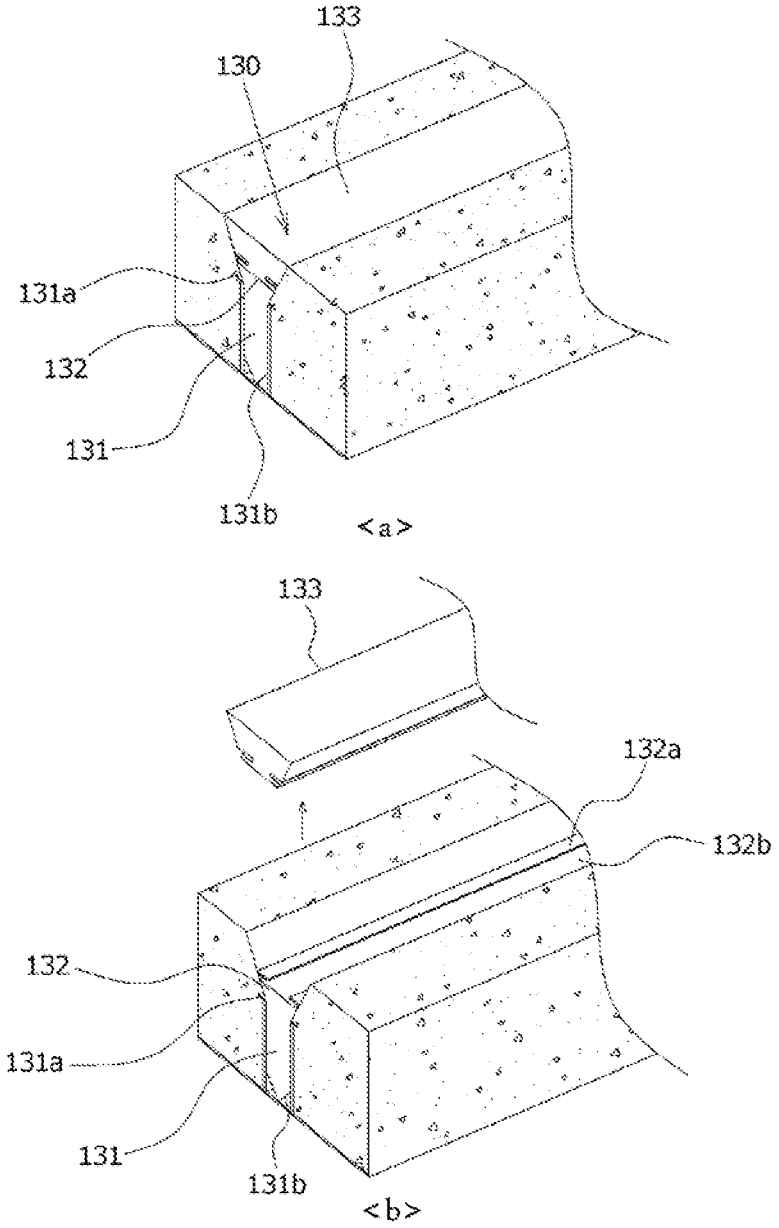

[Fig. 5]
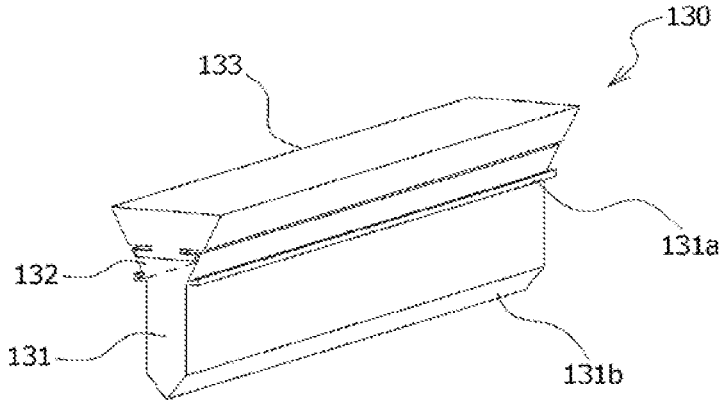
<a>
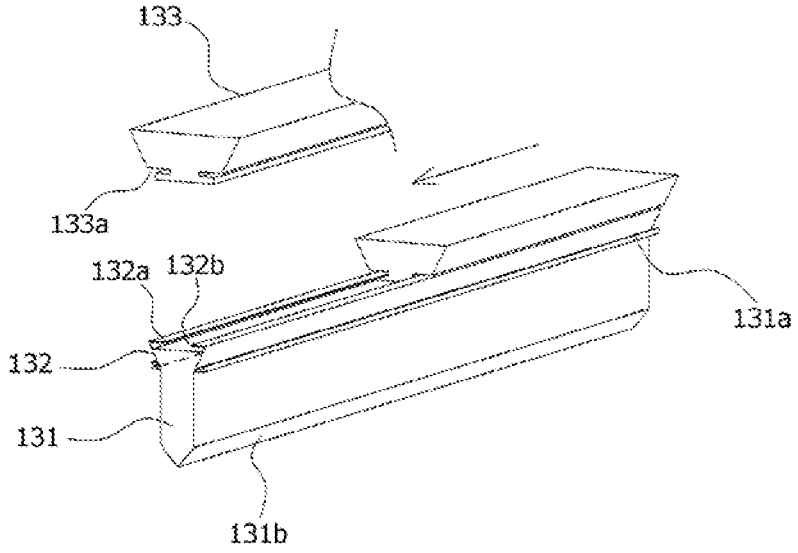
<b>

[Fig. 6]
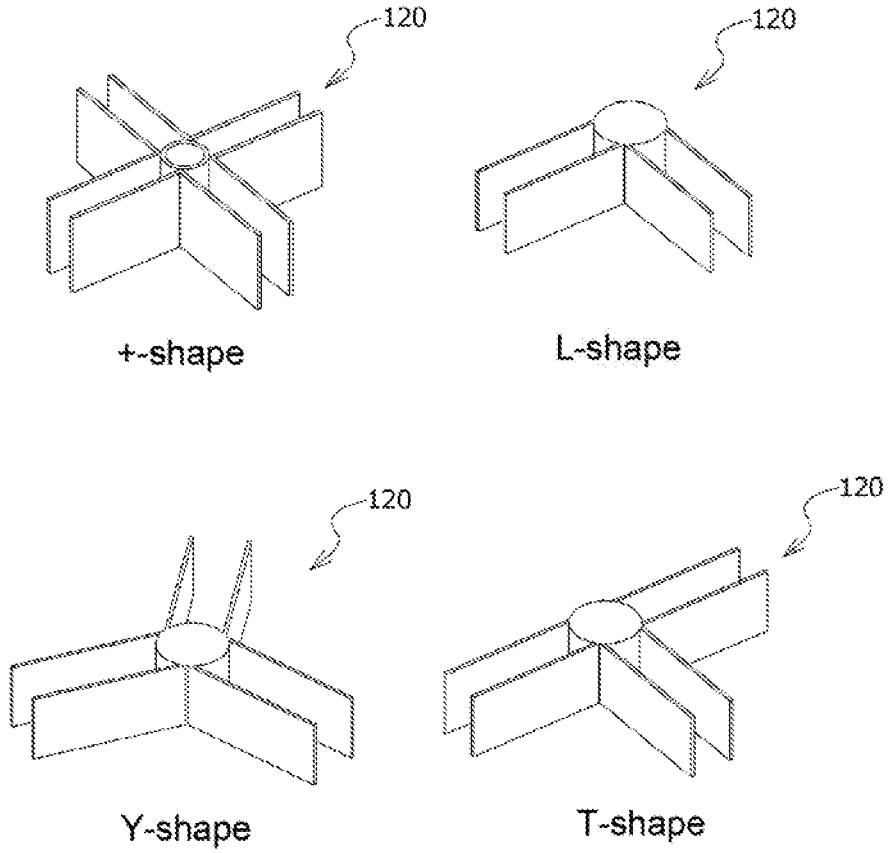

METHOD FOR INSTALLING CONCRETE CRACK INDUCING EXPANSION JOINT FILLER, AND APPARATUS THEREFOR

TECHNICAL HELD

The present invention relates to a method for installing a crack inducing expansion joint filler when placing concrete so as to reduce cracks generated during concrete construction, and an apparatus therefor and, more particularly, to a method for installing a concrete crack inducing expansion joint filler and an apparatus therefor which can vertically install and fix a plurality of fixed rod shafts on a bottom surface, place concrete, and then fit connecting means to the fixed rod shafts while connecting and installing a joint filler member, having a cover means (expansion joint filler marker) which can be attached and detached between the connecting means, before the concrete is cured. Thus, since it is possible to install the joint filler member at the same time as placing the concrete on the bottom surface, the method and apparatus can significantly reduce the concrete construction period and also cause that cracks generated by the joint filler during concrete curing can be reduced to a minimum, thereby increasing concrete durability and enhancing construction efficiency.

DISCUSSION OF RELATED ART

Generally, concrete is primarily used to pave the rooftop slave of apartment complexes or other various buildings, roads, ground, or underground parking lots, train station platforms, or subway roadbeds.

In the case of construction using concrete, which is a mix of cement, sand, gravel, and water, water evaporates from in the concrete while the concrete is cured, leaving gaps in the concrete. Such gaps repeatedly expand or contract due to heat in the air, causing cracks in the concrete.

Water may flow in the cracks, negatively affecting the building.

Thus, there is considered a method for constantly inducing cracks in the concrete in light that cracks are created in proportion to the area of installation of concrete in order to prevent or suppress such cracks.

For structural safety purposes by inducing cracks in the concrete, upon concrete construction, expansion joint fillers may be put at constant intervals or the concrete surface may be cut horizontally and vertically using a wet cutting machine or dry cutting machine.

Conventional expansion joint fillers absorb the expansion and contraction of concrete as the external air varies in temperature so that cracks by the expansion and contraction of concrete may be constantly induced along the expansion joint fillers, thus preventing durability of concrete from weakening due to water leakage by unpredicted cracks.

Such conventional expansion joint fillers are configured and installed in various forms.

Representative expansion joint fillers are disclosed in Korean Patent No. 10-0542380 titled "expansion joint filler structure for concrete slab and method for constructing the same" and Korean Patent No. 10-0385130 titled "expansion joint filler for concrete slab."

The "expansion joint filler structure for concrete slab and method for constructing the same" disclosed in Korean Patent No. 10-0542380 is described below.

A concrete slab expansion joint filler structure for protecting a rooftop waterproof layer of a building includes thermal insulator expansion joint fillers 200 arranged in a grid on the waterproof layer 120; pressing concrete 130 poured and cured along with a wire mesh 132 on the thermal insulator expansion joint fillers 200 and the waterproof layer 120; a backup material 150 inserted into a cutting portion 220 obtained by cutting the pressing concrete 130 on the thermal insulator expansion joint fillers 200 after the pressing concrete 130 is cured; and a sealant 160 provided on the backup material 150.

Further, the invention provides a method for constructing concrete slab expansion joint fillers for protecting a rooftop waterproof layer of a building, comprising the steps of (a) arranging thermal insulator expansion joint fillers 200 in a grid on the waterproof layer 120; (b) placing a wire mesh 132 on the thermal insulator expansion joint fillers 200 and the waterproof layer 120; (c) pouring and curing pressing concrete. 130 on the thermal insulator expansion joint fillers 200 and the waterproof layer 120; (d) cutting the pressing concrete 130 on the thermal insulator expansion joint fillers 200 after the pressing concrete 130 is cured to form a cutting portion 220; (e) inserting a backup material 150 into the cutting portion 220; and (f) putting a sealant 160 on the backup material 150 to finish off.

This is related to an expansion joint filler structure for concrete slab and construction method which installs thermal insulator expansion joint fillers on a waterproof layer, pours and cures pressing concrete, and then cuts a portion of the pressing concrete on the thermal insulator expansion joint fillers, and inserts a backup material and sealant into the cutting portion.

PRIOR TECHNICAL DOCUMENTS

Patent Documents (Patent Document 1) KR 10-0385130 published on May 12, 2003.

(Patent Document 2) KR 10-0542380 published on Jan. 3, 2006.

(Patent Document 3) KR 20-0129425 published on Aug. 19, 1998.

SUMMARY

However, the conventional "expansion joint filler for concrete slab" has such structure that a connecting member is installed in a supporting member provided in a support, and a shock-absorbing part consisting of a supporting mechanism and a spring is provided in the connecting member to respond to the expansion and contraction of concrete, thereby preventing cracks in the concrete. Such structure is complicated and high in manufacturing costs, rendering itself uneconomical.

Further, since the conventional expansion joint filler is installed by the method of pouring concrete after the joint fillers are placed and fastened to the bottom surface, the joint fillers may be relocated or buried by pouring concrete.

Further, the conventional expansion joint filler should be installed on the bottom surface before pouring concrete, which requires more labor and costs, resulting in an increased construction time.

The present invention has been conceived to address the above issues.

An object is to provide a method for installing concrete crack inducing expansion joint fillers and expansion joint filler apparatus allowing an expansion joint filler apparatus including a plurality of fixed rod shafts installed and fixed at constant intervals on a bottom surface where concrete is placed, connecting means fitted and fastened to the fixed rod shafts, and an expansion joint filler member detachably installed between the connecting means to be configured to be installed before the concrete is cured, so that the expansion joint filler member may be installed simultaneously with placing the concrete on the bottom surface, thus significantly reducing the concrete construction period and allowing the expansion joint filler member to minimize cracks occurring when the concrete is cured, thereby leading to enhanced concrete durability and construction efficiency.

To achieve the above object, according to the present invention, an expansion joint filler apparatus installed on a bottom surface where concrete is placed to induce a crack comprises a plurality of fixed rod shafts each including a plate fixed to the bottom surface and a rod shaft vertically provided and fixed to an upper surface of the plate joint members each including a fitting installation pipe fitted and fastened to a corresponding one of the fixed rod shafts and multiple wing plates along a circumferential surface of the fitting installation pipe, and an expansion joint filler member fitted into the wing plates to connect and fasten the joint members.

According to the present invention, a method for installing an expansion joint filler apparatus installed on a bottom surface where concrete is placed to induce a crack comprises fixing a plate on the bottom surface by way of an adhering means while installing and fixedly arranging fixed rod shafts, placing the concrete on the bottom surface where the fixed rod shafts are arranged, fitting and fastening joint members to the fixed rod shafts when the concrete is in a mortar form before cured, and installing an expansion joint filler member between the joint members while pushing the expansion joint filler member so that a lower support of the expansion joint filler member is inserted into a space portion formed between a front plate and a rear plate of the joint members while the concrete is in the mortar form before cured.

According to the present invention, in the method for installing concrete crack inducing expansion joint fillers and apparatus therefor, the rod shafts are fastened at constant intervals to the bottom surface where the concrete is placed, and the concrete is then placed, and before the concrete is cured, the expansion joint filler member may be installed. Thus, the concrete construction period may be remarkably reduced, leading to low-cost construction and economy.

Further, according to the present invention, the connecting means are fitted over the rod shafts fixedly installed to the bottom surface, and the expansion joint filler member may be fittingly installed to the connecting means, allowing for simplified installation of the expansion joint filler member.

Further, according to the present invention, the expansion joint filler member is hollow to absorb the expansion and contraction of concrete, preventing the concrete from cracking while allowing for simple, low-price manufacture.

Further, according to the present invention, the connecting means for connecting and installing the expansion joint filler member may be formed in various shapes, such as a rectangular, triangular, or T shape, allowing for quick response to the environment of the bottom surface where the expansion joint filler member is constructed. Further, a color may be applied to the upper surface of the expansion joint filler member, allowing the bottom surface various decorations.

Further, according to the present invention, the upper portion of the expansion joint filler member is configured as a detachable expansion joint filler cover (marker). Thus, the expansion joint filler cover may be removed as necessary, and a sealing means, such as silicone, may be applied, providing for significantly enhanced sealing efficiency.

BRIEF DESCRIPTION OF THE DRAWINGS

FIGS. 1 and 2 are perspective views illustrating a concrete crack inducing expansion joint filler apparatus according to the present invention;

FIG. 3 is an exploded perspective view schematically illustrating a concrete crack inducing expansion joint filler apparatus according to the present invention;

FIG. 4 is a cross-sectional view illustrating an example in which concrete is poured with a concrete crack inducing expansion joint filler apparatus installed, according to the present invention;

FIG. 5 is a view schematically illustrating a main part of a concrete crack inducing expansion joint filler apparatus according to the present invention; and FIG. 6 is a view schematically illustrating various examples of a connecting means of a concrete crack inducing expansion joint filler apparatus according to the present invention.

DETAILED DESCRIPTION OF EXEMPLARY EMBODIMENTS

Hereinafter, preferred embodiments of the present invention are described with reference to the accompanying drawings to be easily practiced by one of ordinary skill in the art.

According to the present invention, as shown in FIGS. 1 to 5, a concrete crack inducing expansion joint filler apparatus 100 includes a plurality of fixed rod shafts 110 fixed and installed at predetermined intervals on a bottom surface where concrete is poured and placed, joint members 120 including fitting installation pipes 121 fitted and fastened to the fixed rod shafts 110 and multiple wing plates 122 provided along circumferential surfaces of the fitting installation pipes 121, and expansion joint filler members 130 fitted into the wing plates 122 of the joint members 120 and connecting and fastening the joint members 120.

In such construction that concrete is poured on a broad bottom surface, such as an underground or above-ground parking lot or rooftop to securely maintain the bottom surface, water evaporates as the concrete is cured, causing cracks to irregularly occur in the cured concrete bottom surface. To prevent this, concrete is poured, with expansion joint fillers installed to induce cracks during concrete construction.

Accordingly, the concrete crack inducing expansion joint filler apparatus 100 according to the present invention is installed on the bottom surface to prevent cracks from occurring upon concrete construction.

Here, the fixed rod shafts 110 each include a plate 111 fixed to the bottom surface and a rod shaft 112 vertically installed and fixed to the top of the plate 111.

Thus, the plate 111 is fixedly installed on the bottom surface of the constructed building using an adhering means, such as mortar or a glue or adhesive.

Then, the rod shaft 112 provided on the top of the plate 111 may be installed and fastened perpendicular to the bottom surface.

The rod shaft 112 may be formed in a multi-part, telescopic antenna structure that may expand or contract so that its length is adjustable.

Accordingly, the rod shaft 112 may be rendered to expand or contract in length depending on the thickness of concrete placed on the bottom surface of the building.

The wing plates 122 of the joint member 120 include a pair of front plate 122*a* and rear plate 122*b* and a space portion 122*c* spacing the front plate 122*a* and the rear plate 122*b* apart from each other. A side surface portion of the wing plates 122 is connected to the fitting installation pipe 121 to be closed, and the other side surface portion thereof is open.

A plurality of wing plates 122 are provided along the circumferential surface of the fitting installation pipe 121, and the angle between the wing plates 122 may be 90 degrees so that the joint member 120 is shaped as a rectangle, or the angle between the wing plates 122 may be 120 degrees so that the joint member 120 is shaped as a triangle.

As such, the joint member 120 may have various shapes, such as a rectangular shape, triangular shape, T shape, Y shape, or L shape, by adjusting the number and angle of the wing plates 122.

The expansion joint filler member 130 may be formed of an elastic material, such as PVC. The expansion joint filler member 130 includes a hollow lower support 131 having both ends each of which may be inserted into the space portion 122*c* between the front plate 122*a* and the rear plate 122*b*, an inverted trapezoidal, hollow upper head 132 formed to continuously communicate with an upper end of the lower support 131 to prevent the lower support 131 from sliding down along the space portion 122*c*, and an inverted trapezoidal expansion joint filler marker 133 detachably fitted into the upper head 132.

Protrusions 132*a* projecting upwards and having ends bent inwards are formed at two opposite side edges of an upper portion of the upper head 132, and an upper surface of the upper head 132 forms grooves 132*b* by the protrusions 132*a*.

Fitting grooves 133*a* are formed in side edges of a lower portion of the expansion joint filler marker 133 to allow the protrusions 132*a* to be fitted and supported.

Thus, as the protrusions 132*a* are fitted along the fitting grooves 133*a*, the expansion joint filler marker 133 may be positioned and fastened to the upper head 132.

Further, in the expansion joint filler member 130 according to the present invention, as the expansion joint filler marker 133 is pulled upwards from a side surface, with the expansion joint filler marker 133 is fitted to the upper head 132, the protrusions 132*a* may be elastically deformed to be escaped from the fitting grooves 133*a*. Thus, the expansion joint filler marker 133 may be easily attached or detached from the upper head 132.

In case a gap occurs between the side surface of the embodiment marker 133 and the concrete due to the contraction of the concrete when the concrete is cured, the expansion joint filler marker 133 may be replaced with another expansion joint filler marker as large as the size of the gap to fill the gap, or a sealing means may be applied to the grooves 132*b* formed on the upper surface of the upper head 132, with the expansion joint filler marker 133 removed, thereby preventing the influx of, e.g., moisture.

Further, wing protrusions 131*a* are formed on both side portions of the lower support 131 constituting the expansion joint filler member 130 to prevent the concrete from pushing up the expansion joint filler member 130 as the concrete contracts when it is placed in the concrete.

Further, the lower end of the lower support 131 of the expansion joint filler member 130 is formed as an inserting portion 131*b* with a cone-shaped sharp tip allowing it to be easily placed in the concrete before the concrete is cured.

A method for installing the concrete crack inducing expansion joint filler apparatus 100 configured as above, according to the present invention, is described below.

First, multiple fixed rod shafts 110 are arranged and fastened to the bottom surface where concrete is to be poured at constant intervals using an adhering means, such as mortar or adhesive (the step of adhering and fastening the fixed rod shafts 110 to the bottom surface).

At this time, since the plates 111 have a large area, it may be easily attached to the bottom surface by way of the adhering means. Further, the rod shaft 112 is installed to expand or contract fitting the thickness of the thickness of the concrete placed.

In this case, the position where the fixed rod shafts 110 are to be fixed is previously designed and marked.

Subsequently, concrete is poured and placed on the bottom surface (the step of placing concrete).

At this time, as the fixed rod shafts 110 are soaked in the concrete, only the rod shafts 112 are shown. Here, the fixed rod shafts 110 may be adjusted to expand fitting the thickness of the placed concrete.

The joint members 120 are fitted and installed to the rod shafts 112 when the concrete remains mortar before cured (the step of fitting and fixing the joint members 120 to the fixed rod shafts 110 in the concrete of the mortar form).

At this time, since the concrete is placed on the bottom surface, only the rod shafts 112 are shown, but the plates 111 are not. Thus, the joint members 120 may be simply installed to the fixed rod shafts 110 by fitting the fitting installation pipes 121 over the rod shafts 112.

Then, when the concrete remains in the form of mortar before cured, the expansion joint is filler member 130 is pressed down between the joint members 120 so that the lower support 131 is fitted into the space portion 122*c* between the front plate 122*a* and the rear plate 122*b* (the step of coupling the expansion joint filler member 130 between the joint member 120 and its neighboring joint member 120 in the concrete of mortar form).

Here, the lower support 131 may be easily installed because the inserting portion 131*b* formed at the lower tip of the lower support 131 is pressed down into the mortar-form concrete.

In such case, even when the concrete contracts while cured, the expansion joint filler member 130 is prevented from being pushed up by the wing protrusions 131*a* formed on both side surfaces of the lower support 131.

Further, at this time, the expansion joint filler member 130 is pushed down while tapped, so that the upper surface of the expansion joint filler marker 133 is on the same level as the concrete surface.

As the concrete is cured, the bottom surface construction is complete (the step of curing concrete).

The concrete contracts as cured on the bottom surface. At this time, even when the expansion joint filler member 130 is pressurized by the contracting concrete, cracks may be prevented from occurring or induced because the expansion joint filler member 130 is formed of an elastic material and includes a space absorbing the contracting force of the concrete.

Further, as the concrete contracts, gaps may occur in the outer surface of the expansion joint filler marker 133 of the expansion joint filler member 130. In this case, the expansion joint filler marker 133 may be pulled up, removed, and replaced with a larger expansion joint liner marker to remove (fill) the gaps.

By doing so, the gaps created by the expansion joint filler member 130 may be filled, preventing influx of moisture into the inside of the concrete.

Further, as necessary, the expansion joint filler marker 133 may be pulled up and removed, and a sealing member, such as silicone, may be applied for sealing to the grooves 132*b* formed on the upper surface of the upper head 132.

Further, according to the present invention, various colors or shapes may be applied to the expansion joint filler marker 133 to show a diversity of colors or shapes, decorating the bottom surface.

As described above, according to the method for installing concrete crack inducing expansion joint fillers and expansion joint filler apparatus allowing an expansion joint filler apparatus including a plurality of fixed rod shafts installed and fixed at constant intervals on a bottom surface where concrete is placed, connecting means fitted and fastened to the fixed rod shafts, and an expansion joint filler member detachably installed between the connecting means to be configured to be installed before the concrete is cured, so that the expansion joint filler member may be installed simultaneously with placing the concrete on the bottom surface, thus significantly reducing the concrete construction period and allowing the expansion joint filler member to minimize cracks occurring when the concrete is cured, thereby leading to enhanced concrete durability and construction efficiency.

What is claimed is:

1. An expansion joint filler apparatus comprising:

a plurality of rod fixing pins each including a plate having a straight flat shape and a rod shaft having a cylindrical shape and vertically provided and fixed to an upper surface of the plate;

joint members each including a fitting installation pipe fittingly coupled with an outer surface of the rod shaft to be fastened and having a cylindrical shape and multiple wing plates along a circumferential surface of the fitting installation pipe; and an expansion joint filler member having two ends fitted into the wing plates, wherein the wing plates include a front plate, a rear plate, and a space portion, wherein the front plate and the second plate are paired, positioned parallel to each other, and are spaced apart from each other by the space portion, wherein the front plate and the second plate include their respective first ends and their respective second ends, wherein the respective first ends of the front plate and the second plate are connected to the fitting installation pipe to close a space between the respective first ends of the first plate and the second plate, wherein an opening is formed between the respective second ends of the front plate and the second plate, wherein the expansion joint filler is inserted between the front plate and the rear plate, wherein the expansion joint filler member is formed of an elastic material and includes a hollow lower support having ends, each of said ends may be inserted into the space portion between the front plate and the rear plate, an inverted trapezoidal, hollow upper head formed to continuously communicate with an upper end of the lower support to prevent the lower support from sliding down along the space portion, and an inverted trapezoidal expansion joint filler marker detachably fitted into the upper head, wherein a lower end of the lower support has a sharp inserting portion, wherein protrusions projecting upwards and having ends bent inwards are formed at two opposite side edges of an upper portion of the upper head, and an upper surface of the upper head forms grooves, and wherein fitting grooves are formed in side edges of a lower portion of the expansion joint filler marker to allow the protrusions to be fitted and supported.

2. The expansion joint filler apparatus of claim 1, wherein the joint member is formed to have a rectangular or triangular shape, a T shape, a Y shape, or a L shape by adjusting the number and angle of the wing plates.

3. The expansion joint filler apparatus of claim 1, wherein the rod shaft of the rod fixing pin is formed in a multi-part, telescopic antenna structure that may expand or contract so that its length is adjustable.

* * * * *